United States Patent [19]

Kings et al.

[11] 4,373,016

[45] Feb. 8, 1983

[54] PROCESS OF TRANSFERRING MONOCOMPONENT DEVELOPING POWDER WITH A VOLATILE, DIELECTRIC LIQUID

[75] Inventors: Donald H. M. Kings, St. Nicolas D'Aliermont; Jean-Claude Marckmann, Arques la Bataille; Pham K. Quang, Dieppe, all of France

[73] Assignee: Rhone-Poulenc Systemes, Paris, France

[21] Appl. No.: 262,827

[22] Filed: May 12, 1981

[30] Foreign Application Priority Data

May 12, 1980 [FR] France ..... 80 10611

[51] Int. Cl.[3] ..... G03G 13/16

[52] U.S. Cl. ..... 430/126; 355/3 TR; 427/14.1

[58] Field of Search ..... 430/126; 427/14.1; 355/3 TR

[56] References Cited

U.S. PATENT DOCUMENTS

| | | | |
|---|---|---|---|
| 3,856,519 | 12/1974 | Honjo et al. | 430/126 X |
| 4,007,041 | 2/1977 | Chow | 430/126 X |

FOREIGN PATENT DOCUMENTS

| | | |
|---|---|---|
| 1913173 | 6/1970 | Fed. Rep. of Germany . |
| 2042567 | 3/1971 | Fed. Rep. of Germany . |
| 38-12993 | 7/1963 | Japan . |
| 46-43438 | 12/1971 | Japan . |
| 51-40937 | 4/1976 | Japan . |

OTHER PUBLICATIONS

Bean et al., "Improved Transfer", Xerox Discl. Jour., vol. 3, No. 5, Sep./Oct. 1978, p. 355.

*Primary Examiner*—Roland G. Martin, Jr.
*Attorney, Agent, or Firm*—Sherman & Shalloway

[57] ABSTRACT

This invention provides a process of electrographic reproduction onto an arbitary support, whereby an image of a magnetic, monocomponent developing powder is transferred, under the influence of electrical means, onto a support covered with a thin layer of volatile dielectric liquid having a volume resistivity greater than $10^3$ ohm-cm$^2$/cm.

19 Claims, 8 Drawing Figures

PROCESS OF TRANSFERRING MONOCOMPONENT DEVELOPING POWDER WITH A VOLATILE, DIELECTRIC LIQUID

BACKGROUND OF THE INVENTION

1. Field of the Invention

The present invention relates to a process of electrographic reproduction on an arbitrary support, with the aid of a magnetic, monocomponent developing powder. More particularly, it relates to a process of electrographic reproduction in which an image of electrostatic charges formed on an intermediate support, such as a photoconductor or any other surface capable of retaining an image of electrostatic charges, is developed with the aid of a magnetic, monocomponent developing powder to form a powder image which is transferred by the action of electrical means (e.g., an electric field, corona discharge device, etc.) to an arbitrary support, with the image thus obtained being fixed on the support by pressure or heat.

2. Description of the Prior Art

Electrographic document copying processes, particularly those using ordinary paper, have been refined to a substantial degree over the past ten years.

Basically in these processes, a uniform charge is produced on a photoconductor with the aid of a corona effect device (hereinafter called a "corona device"). By selective exposure starting with an original, an image of charges is produced which is subsequently developed with the aid of a developing powder.

There are a number of types of known developing powders of which the following are noteworthy:

(1) Developing powders with two components (hereinafter called "bicomponent powders") which use two types of particles, the vehicle (or "carrier") and the developer (or "toner"). The vehicle generally comprises glass microspheres or the like which have a large diameter as compared to the developer particles. The developer particles are held on the surface of the vehicle particles by triboelectricity and are based on carbon black surrounded by, i.e., coated with resin; and (2) Monocomponent developing powders which employ only a single type of particles, generally magnetic particles coated with appropriate resins; depending on the conditions of manufacture these particles have a more or less conducting nature.

The development of the image of electrostatic charges with the aid of a bicomponent developing powder may be effected by various processes, of which currently the most widely used are:

(1) The so-called "cascade process," such as described in U.S. Pat. No. 2,618,552, in which the developer particles are deposited on the charges of the latent image having opposite sign to the charges borne by said particles, by means of electrostatic attraction. The powder images thus developed are generally easily transferrable under the action of an external electric field or under the action of a "corona"; and (2) The developing process employing a magnetic brush, such as described in U.S. Pat. No. 2,874,063, in which the vehicle particles comprise smooth iron filings which may be coated with a triboelectric resin. The developer particles are generally held onto the vehicle particles by triboelectricity.

In the two processes wherein bicomponent developing powders are used, it is essential that the developer particles are insulated to a high degree so as to retain their charge needed for good development of the image. In this connection such development processes employing bicomponent developing powders have certain disadvantages. Since the developer particles are held electrostatically to the surface of the vehicle, it is essential that the two elements are provided in the correct ratio. If there is an excess of developer particles they are no longer sufficiently retained by the vehicle particles but are dispersed in the machine, causing significant soiling of said machine, particularly regarding the optical system. This necessitates frequent cleaning of the machine, giving rise to major maintenance costs for this type of machine.

Certain automatic dosing devices for maintaining the quantity of developer have been employed. These devices add developer after each copy, but they are not entirely satisfactory since the quantity of developer used for the development of a copy depends essentially on the nature of the original—in particular, the amount of black therein.

Another disadvantage connected with the use of bicomponent developing powder is the need to mechanically clean the photoconductor after each copy. This cleaning necessitates a complex system of mechanical brushes and of aspiration, which are also sources of contamination of the apparatus (in contrast to cleaning systems where a monocomponent magnetic toner is employed, in which case a magnetic brush is used for the cleaning).

For these reasons in recent years electrostatic copying machines have been developed which employ monocomponent magnetic developing powders of a more or less conducting nature. In general, to develop an image of electrostatic charges using monocomponent developing powders, a magnetic brush is used comprising a metallic cylinder inside which magnets may be revolved, which cylinder is covered with a layer of monocomponent magnetic developing powders. These powders generally have a more or less conducting nature, and are charged by induction with the approach of the image of charges to the developer; the development may be promoted by the presence of an external electric field.

It should be noted that the use of monocomponent developing powders is not a development solely in the realm of powders having a magnetic character. There are also nonmagnetic monocomponent-type powders, such as those described in Fr. Pat. No. 2,362,428; and the present invention applies as well to such systems.

Monocomponent developing powders, and in particular those of a magnetic character, have the advantage of not soiling the machine in which they are used, since they are held securely on the magnetic brush. Such powders are currently widely used in so-called "direct" processes, wherein, for example, they are used for the development of photoconducting zinc oxide papers. In this application they are completely satisfactory. However, this direct process is only used on low-output machines, because it is more economical to employ machines using plain paper when one intends to make a large number of copies, i.e., more than 3000 to 5000 copies per month. Also, users tend to prefer copies on an ordinary support.

However, thus far, despite numerous attempts, it has been impossible to obtain copies of good quality with images of monocomponent developing powder transferred to an arbitrary support, in particular to plain paper. Worthy of note is the fact that current commercial machines employing monocomponent developing powders to form a powder image on a so-called "plain paper" support do not in fact use ordinary paper but a treated paper having a low surface conductivity. The use of true plain paper in such machines yields images of only mediocre quality which are defective in clarity and definition, and this mediocrity is aggravated in the event of high ambient humidity. The present inventors believe that electrical microdischarges are produced during the transfer of the powder image, with the phenomenon being intensified or amplified in the event of increased surface conductivity of the support, notably due to excessive humidity. Furthermore, this phenomenon is more significant as a result of the fact that the developing powder has low surface resistivity. This is because the current machines which use these monocomponent developing powders employ treated paper which is covered with a resin coating which makes its surface conductivity low. Among such treatments one might note, in particular, that described in U.S. Pat. No. 4,199,356, according to which a viscous liquid is applied, e.g., a silicone oil, to the paper which is to receive the final image. Such a process, in addition to the fact that it is applied only to a final receptor paper and not to intermediate organs and therefore does not protect the latter, leaves an oily insulating deposit on the paper. Such paper is much more costly than plain paper, and/or it has an inferior appearance. This necessitates maintaining a special stock, and therefore the user cannot always use the support of his choice.

As a response to variations in conductivity connected with atmospheric conditions it has been proposed to use plain paper which has been pre-dried. This necessitates special equipment in the machine, and it still does not completely solve the problem. In practice it has been found that, although the quality of the copy is improved, an "explosion" effect is observed in the image, amounting to a lack of clarity of outlines, which may render the image illegible when sharpness of definition is the deciding factor.

Other solutions have been tried with regard to monocomponent developing powders. For example, an attempt has been made to reduce the conductivity of the powder by using an increased amount of the appropriate coating resins. This appreciably increased the quality of the transferred image, but the development speed decreased abruptly, which is unacceptable. This is explained by the fact that since an electrical charge is placed on the developing powder by induction due to the presence of the charges in the charged image on the intermediate organ, the speed of the charging of the powder depends on the time constant RC of the powder particles. If the resistivity of the powder is increased, the polarization time for induction on the powder particles at the approach of the charges in the charged image on the intermediate organ increases correspondingly and quickly becomes excessive, especially in relation to the development time of the charged image. As a result the development speed of the charged image must be reduced, and correspondingly the speed of movement of the paper must also be reduced. Consequently, with a system using this type of developing powder one cannot achieve a high enough copying rate to make the machine competitive.

None of the solutions proposed heretofore actually permits the use of monocomponent developing powder in a machine where the powder image is transferred to a plain paper support such that a good quality image is obtained thereon (i.e., good contrast, no "explosion," no edge effects, etc.), without limiting the development speed of the image and without regard to the atmospheric conditions.

SUMMARY OF THE INVENTION

The present invention introduces a solution to the above problem and permits one to avoid the drawbacks connected with the use of monocomponent developing powder. Toward this end, the process according to the invention is characterized in that the support is coated, prior to the transfer of the powder image, with a thin layer of a volatile dielectric liquid having a volume resistivity greater than $10^3$ ohm-cm$^2$/cm, whereby this liquid is present on the support during at least the interval of time necessary for the powder image to be transferred to the support.

Preferably, a liquid is employed having a volume resistivity greater than $10^7$ ohm-cm$^2$/cm, and still better results are obtained if this value is greater than $10^{10}$ ohm-cm$^2$/cm. The best results occur at a volume resistivity of about $10^{15}$ ohm-cm$^2$/cm.

DETAILED DESCRIPTION OF THE INVENTION

Figure 1:
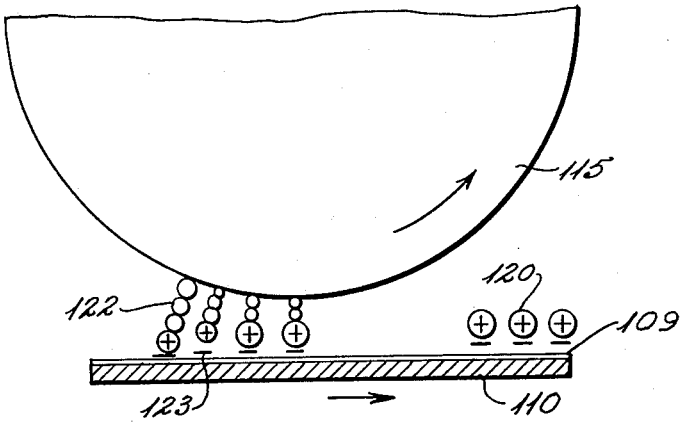
FIG. 1 is an illustration of the effects produced at the moment of development of the image with the aid of a monocomponent developing powder.

Quite surprisingly, the present process produces images of distinctly better quality than those obtained (all other things being equal) in the absence of the dielectric liquid. Thus, the present process even permits the utilization of a highly conductive material such as a metal as the arbitrary support (as will be seen further herein), while obtaining an image of excellent quality having good density and excellent clarity (free of "explosion").

Without being committed to any particular theory, the present inventors believe that the relatively conducting developing powder particles, when they are transferred under an electric field to a surface having a dielectric character, cannot instantaneously exchange their induced charge when they come in contact with the receptor (i.e., the support). As a result, they remain attracted to this surface, whereby the quantity of developing powder transferred is increased.

Additionally, the developing powder particles are wetted by the dielectric liquid, which contributes to limiting the exchange of charges between the particles and the copy support. The parasitic i.e., spurious discharges which give rise to image "explosion" are thus suppressed. If a developing particle comes in contact with a relatively conductive receptor surface the charge carried by the particle may be neutralized, whereby the particle will no longer be held by electrostatic force but will be moved back away from the image zone and possibly toward the photoconductor, which produces the above-mentioned deteriorations.

The scope of the present invention includes a developing powder which is monocomponent and relatively conducting, in particular a developing powder for electrographic images, said powder containing only one type of particle and having a volume resistivity less than or at most equal to $10^{15}$ ohm-cm$^2$/cm. In practice, at higher values no further appreciable improvement in the quality of the image transferred in the presence of the volatile dielectric liquid is experienced. The present invention applies also to mixtures of powders such as described supra, with various resistivities and particle sizes.

The improvement in the transferred image is entirely satisfactory for a resistivity between $10^7$ and $10^{15}$ ohm-cm$^2$/cm. Preferably a developing powder is employed having a resistivity between $10^8$ and $10^{13}$ ohm-cm$^2$/cm. The measurement of the resistivity of the developing powder is carried out in a cell of cross section 0.07 cm$^2$ on a sample 2 mm deep, under a pressure of 750 g/cm$^2$ and a continuous electric field of 1000 V/cm.

The image support according to the invention may be of any type, i.e., it may have a surface resistivity less than $10^{13}$ ohm-cm$^2$/cm. Low-resistivity supports such as metallic supports are also accommodated within the scope of this invention. Depending on the type of support employed, different products may be produced by applying the process of the present invention. In the case of hydrophilic supports (treated polyester, metal, coated paper, and the like), lithographic printing plates can be directly produced by using ink attracting toners. Projectable "transparencies" or negatives can be produced directly on transparent polyester film.

The dielectric liquids having a volume resistivity as specified above should not be too volatile, so that it may be assured that they will be present on the copy support at the instant when the powder image is transferred. On the other hand, they should be sufficiently volatile so that the copy can leave the machine in a dry state. Preferably a liquid which has a volatility index between 0.01 and 0.4 is used. The volatility index of a liquid is the ratio of the evaporation time for n-butyl acetate from a paper filter, to the evaporation time for the given liquid. For details concerning the operating conditions and the materials used, see French Standard (Norme Francaise) NF T 30-301 (August, 1969).

According to a variant of the invention, means of drying the support are provided prior to or after the fixing of the image. These means, which are known, may be, for example, combined with the fixing means, when heat rollers are used for fixing. In a simpler fashion, fixing means employing infrared radiation may be used which performs both fixing and drying. These means may be separate when cold fixing is employed; for example, if pressure rollers are used for fixing, infrared lamps or hot air may be used for drying. Generally it is desirable to ensure ventilation for evacuating the vapors which are given off. In a number of cases, however, such drying means are unnecessary, where the liquid used has the appropriate volatility.

One skilled in the art will select the properties of the dielectric liquid depending on the conditions, using the parameters mentioned above. In any event, the dielectric liquid must properly wet the copy support onto which the transfer of the powder image occurs, so that a thin layer of liquid is effectively present at every point of the support during the transfer.

The preferred dielectric liquid is aliphatic hydrocarbons, pure or in mixtures, branched or unbranched, with a boiling point lying in the range between 60° C. and 230° C., preferably between 100° C. and 200° C.

Likewise one may use as the dielectric liquid other compounds having these properties, such as saturated alicyclic hydrocarbons, polyisobutenes, or polyfluoroethylenes; or a mixture of these products. In particular one may mention hexane, heptane, octane, isododecane, and the commercial products known as Isopar C, Isopar E, Isopar G, Isopar K, Isopar L, Isopar M, Shell Sol 70, Shell Sol 71, Shell Sol 72, Shell Sol T, Shell Sol TD, Shell Sol TP, and Sol Par 195–230.

Preferably the dielectric liquids used are not solvents for i.e., do not readily dissolve the photoconducting layer; otherwise they could damage it. It is also preferable that these liquids not be solvents for the resins employed in the developing powder, so that they do not cause even partial softening of the toner, since the toner would be then susceptible to being bound to the photoconducting layer in an undesirable fashion.

The quantity of liquid deposited on the copy support depends particularly on the speed of transport of the support, the nature of the support (porosity, etc.), and the nature of the dielectric liquid itself (evaporation rate, etc.). It also depends on the distance between the means of application of the liquid onto the support and the location of the powder image transfer. As a general rule, it has been found that a quantity of liquid between 0.1 g/m$^2$ and 16 g/m$^2$ enables the desired result to be achieved. In most cases, it has been found that a quantity of dielectric liquid between 2 g/m$^2$ and 5 g/m$^2$ gives excellent results, particularly in cold fixing of the powder image by pressing. The transfer of the image of the developing powder onto the copy support is carried out, depending on the devices utilized and the nature of the copy support, under the influence of an electric field or under the influence of a "corona effect" device. The parameters influencing the use of one or the other transfer means, and influencing the voltages employed, are well known to one skilled in the art.

As will be discussed in more detail herein, the present invention offers a preferred embodiment employing a device with three rollers in a vertical arrangement, with the top roller being the photoconductor drum on which the powder image is produced, and the two lower rollers being metallic, the roller adjacent to the photoconductor receives the powder image, and the powder image is then transferred onto the arbitrary support by means of pressure between the two lower rollers. In using this kind of device, it has been found preferable to partially discharge the photoconductor, particularly by means of irradiation by light, before transferring the powder image (under the influence of an electric field) onto the adjacent metallic roller which is coated with the dielectric liquid. In practice, if the photoconductor is not so partially discharged, regardless of the transfer voltage an image results which is either slightly "exploded," as defined above where the transfer voltage is high or lacks contrast in the case of low transfer voltage. Consequently, the transfer voltage and the voltage of the photoconductor prior to transfer (which voltage results from the presence of surface charges) should be mutually adjusted. These considerations only apply in the case of a so-called direct image, in which the developing powder covers the charges of the charged image on the photoconductor drum. In the case of so-called inverted development it is not necessary to partially discharge the photoconductor but only to adjust the transfer voltage.

The invention will be better understood with the aid of the following non-limiting example embodiments, in conjunction with the drawings. Identical reference numbers in the drawings refer to the same elements.

Figure 2A:
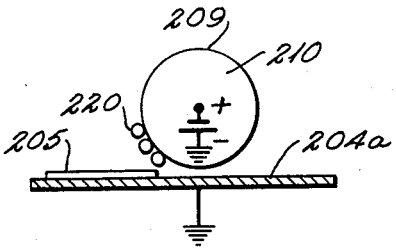
FIGS. 2*a*, 2*b* and 2*c* are illustrations of various schemes for transferring developing powder onto a copy support with the aid of electrical means.
Figure 2B:
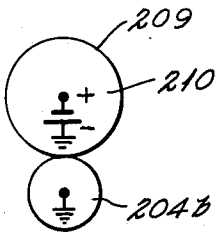
Figure 2C:
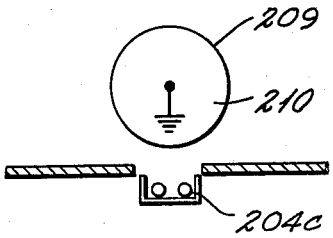

In FIG. 1, magnetic "brush" 115 magnetically holds on its surface the magnetic monocomponent developing powders which form chains of particles represented by 122. With the approach of charges 123 of the charged image formed on photoconductor 109 on body 110, the particles of developing powders are polarized by induction. Thus the part of the particle which is facing negative charge 123 takes on a positive charge equal in magnitude to the negative charge. At this point the electrostatic force between the two charges is sufficient, as a result of the presence of the electric field created by the charged image, to attract the particles onto photoconductor 109, thus forming the powder image 120. FIGS. 2*a*, 2*b* and 2*c* show schematically the three best known variants of systems for transferring a charged developing powder onto a support. In these three variants, the stated polarities relate to the case where the particles are charged positively, as explained in connection with FIG. 1. Clearly, the stated polarities of the voltages should be reversed in the case where the developing powder is negatively charged.

In FIG. 2*a*, cylinder 210, connected to a source of positive voltage, is covered by a photoconductor 209 bearing a powder image 220 which is to be transferred to copy support 205 which travels over grounded guiding support 204.

The developing powder particles are transferred to the copy support under the influence of the electric field which exists between the photoconductor drum and support 204*a* and is directed toward support 204*a*.

In FIG. 2*b*, elements analogous to those in FIG. 2*a* have the same reference numbers. In FIG. 2*b* the copy support is in the form of a conducting cylinder which is connected to ground, and the transfer is improved by the pressure contact between the photoconductor drum 209 and cylinder 204*b*.

In FIG. 2*c*, the transfer is carried out under the influence of a corona effect device 204*c*, with the photoconductor drum 209 being grounded.

Hereinafter "electrical transfer means" will designate one of the means described in FIGS. 2*a*, 2*b* and 2*c*, or any equivalent means.

Figure 3:
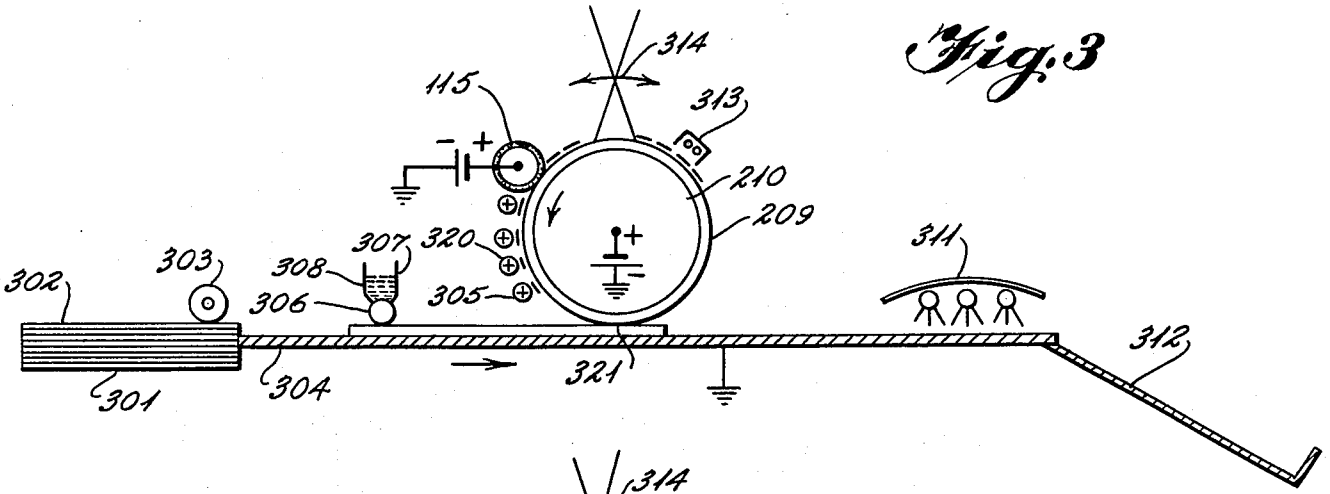
FIG. 3 illustrates an example embodiment of the invention.

In FIG. 3, copy supports 302 stored in holder 301 are started along support 304 by means of feeder 303 when the operator desires to make a copy. Copy support 305, already being processed, is covered with a layer of dielectric liquid 308 contained in reservoir 307, with the aid of coating device 306. Simultaneously a powder image is formed on photoconductor 209 which covers metallic drum 210 which is connected to a source of positive voltage (in the case where the toner is inductively positively charged). A corona effect device 313 deposits a uniform charge on photoconductor 209.

After selective illumination corresponding to the original, through optical system 314, the charged image is developed with the aid of magnetic "brush" 115, and a powder image 320 is formed. This is transferred at 321 to the support 305, under the influence of the positive voltage existing between the photoconductor drum 210 and the grounded support 304. The image is then fixed in infrared furnace 311 and the copy is recovered in tray 312.

Figure 4:
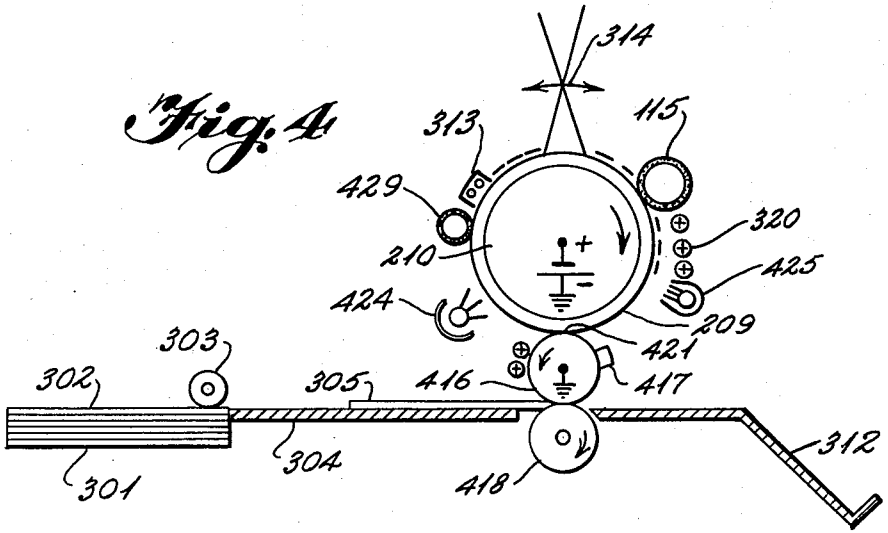
FIG. 4 illustrates a preferred variant of the embodiment of FIG. 3.

FIG. 4 illustrates a particularly interesting embodiment of the invention which incorporates certain examples discussed herein before. Elements corresponding to elements in the preceding Figures have the same reference numbers. The powder image 320 is formed by the same means and in the same fashion as in FIG. 3. Powder image 320 is then transferred, at 421, to grounded metallic roller 416. This roller 416 has been previously coated with a dielectric liquid as described supra, using coating device 417. The powder image thus transferred is then retransferred, by pressure, to copy support 305 which is transported by the rotation of the two rollers 416 and 418; and the mutual pressure of these two rollers causes the powder image 320 to be fixed. This pressure is about 30 kg per linear cm. Illuminating device 425 enables an assured partial discharge of the photoconductor prior to the transfer of the image, when such prior partial discharge is needed. Illumination device 424 enables complete discharge of photoconductor 209 prior to cleaning with magnetic "brush" 429.

Figure 5:
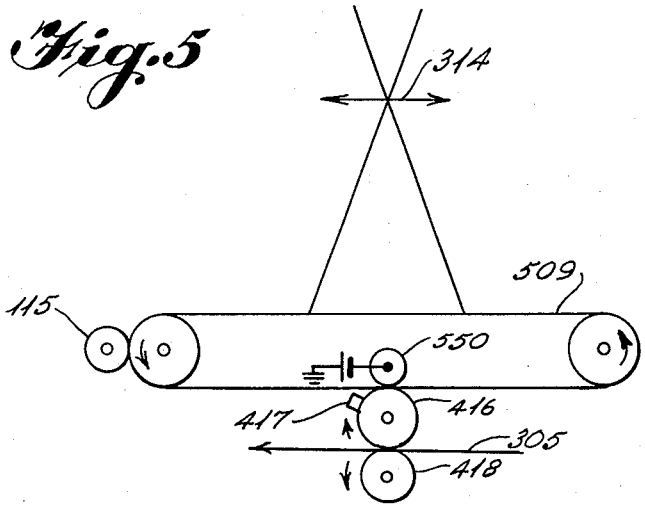
FIG. 5 illustrates a variant of the embodiment of FIG. 4, specially adapted to microcopying.

FIG. 5 shows a variant embodiment of the present invention which is specially designed for reproducing microfilmed images. In this embodiment, a photoconducting band 509 is employed on which the entire image is projected. The charged image on the photoconductor is then developed with the aid of brush 115, and transferred, as in FIG. 4, to a metallic roller 416 which has been coated with a dielectric liquid with the aid of coating system 417. To assure good transfer, counter roller 550 is disposed on the other side of the photoconducting band. The other elements correspond to those in FIG. 4.

Figure 6:
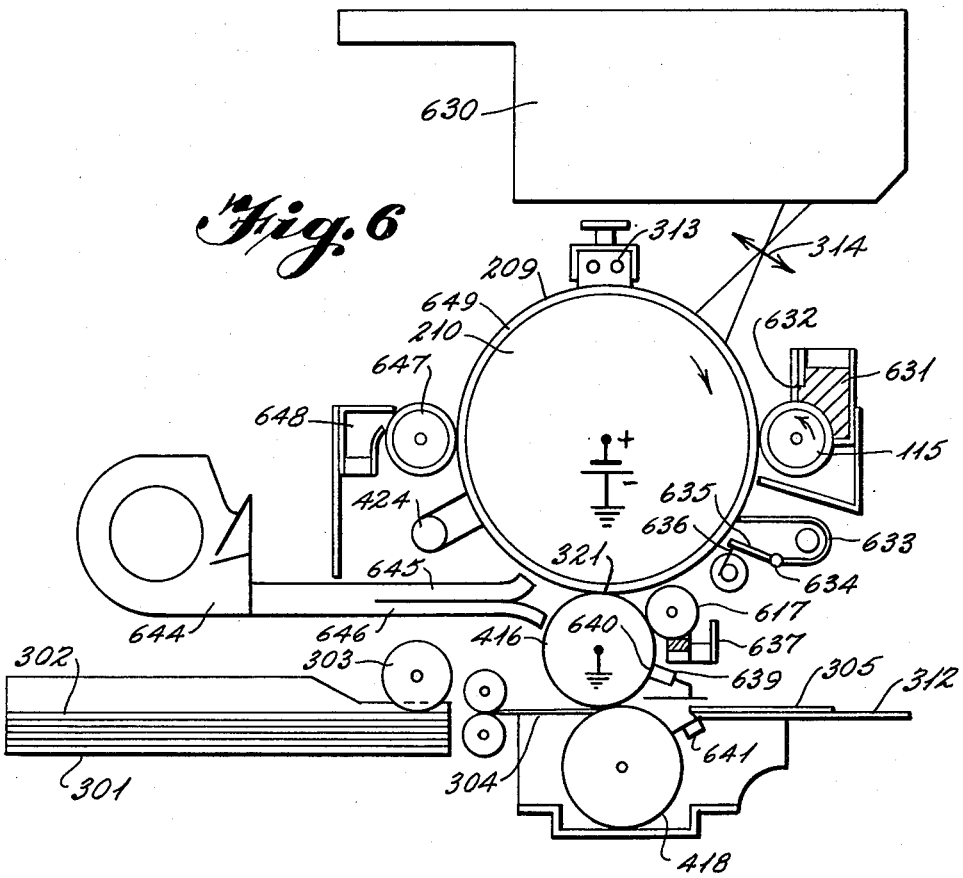
FIG. 6 is an overall schematic diagram of a machine employing the invention as shown schematically in FIG. 4.

FIG. 6 shows another embodiment of the present invention. In this Figure, elements corresponding to elements in the preceding Figures have the same reference numbers. The charged image on photoconductor 209 (which may have a layer of resilient material 649 under it but may have a rigid surface) is produced with the aid of imaging arrangement 630 and optics 314, after uniform charging of the photoconductor with the aid of "corona" 313.

The charged image is developed by means of developing powder 631 which is uniformly deposited on "brush" 115 with the aid of scraper 632. The photoconductor is then partially discharged with the aid of illuminating means 633 the intensity of which is controllable via shutter means 635 which is pivotably mounted around axis 634 with the aid of cam 636. The image is then transferred onto roller 416 which has been previously coated with a dielectric liquid from reservoir 637, via "brush" 617. After the transfer at 321 the powder image is dried by cold or hot air supplied by fan 644 in conduit 646, and the photoconductor is also dried to remove any traces of liquid present with cold or hot air which flows through conduit 645. The image is then transferred to copy support 305, and fixed by pressure, with the aid of the two rollers 416 and 418. Support 305 is separated from cylinder 416 with the aid of scraper 639, and any residual toner on the cylinder is then cleaned with the aid of "brush" 640. Similarly, cylinder 418 is cleaned with brush 641. After the image has been transferred, the photoconductor 209 is discharged using illuminating means 424, and is then cleaned with the aid of magnetic "brush" 647. The excess powder on this brush is recovered in trough 648.

The present invention is further illustrated in the following non-limiting examples.

EXAMPLE 1

This example is carried out using a Sharpfax SF 730 machine which has a zinc oxide photoconducting surface, a monocomponent magnetic developer, and fixing by cold pressure between two metallic rollers. The machine is operated at 20° C. and 65% relative humidity. The copy support is plain paper commercially available under the trade name Voiron Velin SH. The magnetic monocomponent developer is Hitachi Metals Ltd. No. HMT 824/4, with a volume resistivity of $3\times10^{10}$ ohm-cm$^2$/cm measured by the method cited supra. The original to be copied is a pattern having different ranges running from 1 line per mm to 6.3 lines per mm and also having solid parts which permit the optical density of the image to be measured.

The quality of the resulting image is mediocre: The tendency for the lines to "explode" is noted, as well as an only medium level of contrast in the image. The definition observed is 2.8 lines per mm, and the image density is 1.09 (measured on a Macbeth TR 524 densitometer operated in the reflection mode with a green filter).

The same test is repeated with the exception that the copy support is coated prior to the image transfer with an isoalkyl hydrocarbon sold commercially by Esso under the name Isopar G. This dielectric liquid has a resistivity of $5\times10^{14}$ ohm-cm$^2$/cm at 20° C. and volatility index of 0.18. The quantity of liquid deposited on the paper is 3.2 g/m$^2$. All the other parameters of the test are the same as before. After coating, the sheet of paper is immediately introduced into the paper magazine of the Sharp SF 730 machine, and copying is carried out as previously. Comparison of the images obtained with and without the dielectric liquid shows distinct improvement of the image quality when the dielectric liquid is used. In this case the definition obtained is 4.5 lines per mm and the image density is about 1.61.

EXAMPLE 2

The same test is carried out as above, with the same conditions, but the paper used is replaced by paper sold under the trade name Aussedat Rey Unimat 80 g. The improvements in the results observed are: 5 lines/mm with the dielectric liquid versus 3.2 lines/mm without; and a corresponding increase in image density.

EXAMPLE 3

The same test as in Example 1 is carried out, but using a graphic arts type polyester matte sold under the trade name Regma FM by the company Rhone-Poulenc Systemes. In this case the developing powder used is Hitachi Metals Ltd. HMT 808. The copy produced without dielectric liquid is of unacceptable quality, the image being blurred, cloudy, and nonuniform. In contrast, when Isopar G dielectric liquid is deposited on the support before copying, a high quality image of astonishing uniformity and clarity is obtained.

The improvement achieved is a function of the amount of dielectric liquid applied. This example permits measurement of the effect of the amount of liquid applied, since there is no absorption by this type of support. The results obtained are as follows:

| Quantity of Isopar G, g/m$^2$: | Definition, lines/mm: | Image density: |
|---|---|---|
| 0.8 | 3.2 | 1.11 |
| 1.5 | 3.6 | 1.34 |
| 2.5 | 4.5 | 1.44 |

These results show that the quality of the resulting image increases with the quantity of liquid applied per unit surface. However, in practice it may be desirable not to increase the quantity of liquid applied by too much, because this will then necessitate drying of the copies.

EXAMPLE 4

The procedure is the same as in Example 1, but the developing powder used is that furnished with the Sharp SF 730 machine, the powder having a resistivity of $8.3\times10^9$ ohm-cm$^2$/cm, and the Voiron Velin SH paper is treated with isododecane having a resistivity of $1\times10^5$ ohm-cm$^2$/cm and a volatility index of 0.22. The copy is compared with one obtained in the absence of the dielectric liquid, all other factors being the same. Here, too, improvement is observed in the clarity of the lines and the density of the image.

EXAMPLE 5

The arrangement of FIG. **2*b* is used to transfer powder image 220 to the copy support 205. Preferably, with this arrangement (FIG. 2*b*), the cylinder 210 is covered with a layer of resilient material several millimeters thick before applying the photoconductor band 209** to the outside of the cylinder. The quality of the image transfer is thereby improved, under this arrangement.

The charged image formed on the photoconductor is developed with the aid of Hitachi HMT 403 toner, having a resistivity of about $10^{12}$ ohm-cm$^2$/cm. After partial discharge of the photoconductor the powder image is transferred, under 400 V, to an aluminum foil which has been textured for lithography (trade designation CRAO, of the firm Agfa-Gevaert).

If this support is coated before the transfer with a layer of Isopar G, practically all the powder is transferred to the support, and the quality of the image obtained is excellent. In the absence of the dielectric liquid, all other conditions being the same, not over 40% of the powder image is transferred. The powder image is then fixed by heat in an oven at 140° C., followed by treatment with phosphoric acid solution to regenerate the hydrophilic character of the zones not converted by the developing powder.

Subsequently, several hundred imprints are made with the aluminum plate prepared according to the invention without smudging being observed, and with a very good image quality (11 lines per mm).

EXAMPLE 6

With the same equipment as in Example 5 and under the same conditions, a powder image of Hitachi HMT 824/4 monocomponent toner with resistivity (of the toner) $3\times10^{10}$ ohm-cm$^2$/cm, fixable by pressure, is transferred to a polyester sheet coated with a layer of matte material for drawing (Applicant's trade designation FM). The sheet has been previously coated with 5 g/m$^2$ of Isopar G. This produces a good quality copy and transfer of 95% of the toner. (The transfer is carried out under 300 V and partial discharge of the photoconductor.) The same test carried out without the dielectric liquid yields "explosion" of the image just after the image transferred, at the instant of separation of the photoconductor and the copy support. In this case the image obtained is blurred and unusable.

EXAMPLE 7

The test of Example 5 is repeated, using Hitachi heat fixable magnetic toner HMT 403, having a resistivity of about $10^{12}$ ohm-cm$^2$/cm. The transfer is carried out under a voltage of 400 V, with the photoconductor being partially discharged before the transfer. The image is transferred to Voiron Velin SH paper, described supra. In the absence of the dielectric liquid, the image transfers to the extent of 80% but is blurred. Using a mixture of iso-paraffins sold under the trade name Shell Sol T (Shell Oil Company), having a resistivity of $3\times10^{13}$ ohm-cm$^2$/cm, a clear image is obtained which is transferred to the extent of 90%.

EXAMPLE 8

The arrangement shown schematically in FIG. 4 and in more detail in FIG. 6 is used. The photoconductor is zinc oxide type (Regma M 100 BC paper bicharge). Development is with the Hitachi HMT 824/4 toner mentioned supra. The receiving support is Voiron Velin SH paper. The transfer is carried out under a voltage of 300 V, with partial prior discharge of the photoconductor.

In the absence of the dielectric liquid, only 5% of the powder image is transferred to the paper, and the image is barely perceptible.

When the cylinder 416 is wetted with isopropanol having a resistivity of $10^7$ ohm-cm$^2$/cm, about 90% of the powder image is transferred. However, it is found that the image is slightly blurred. If the cylinder is wetted with Isopar G having a resistivity of $5\times10^{14}$ ohm-cm$^2$/cm, around 90% of the powder image is transferred and the copy image is very clear. (In both cases, around 4 g/m$^2$ of the respective dielectric liquid is applied.) This example represents a preferred embodiment of the invention.

EXAMPLE 9

The procedure is the same as in the preceding example but the receiving support used in Regma designation 720 D dielectric paper with a surface resistivity of about $10^{15}$ ohm-cm$^2$/cm; this paper is furnished with a conducting coating on the back. Under the same operating conditions as in Example 8, and under a voltage of 400 V, the results are:

In the absence of the dielectric liquid, only 5% of the powder image is transferred to the dielectric paper, and that transferred image is "exploded."

In the presence of Isopar G, there is 90% transfer, and the copy image is clear.

EXAMPLE 10

The same arrangement is used as in the preceding example. The image is again developed with Hitachi HMT 824/4 toner, except that the support onto which the image is transferred is a Regma FM polyester film, with the transfer occurring under a voltage of 300 V and after partial discharge of the photoconductor. The results are:

In the absence of the dielectric liquid, no more than 5% of the powder image is transferred, and the transferred image is "exploded."

In the presence of Isopar G, there is 90% transfer, and the copy image is clear.

EXAMPLE 11

The arrangement of FIG. 3 is used, having a Regma type M100 BC photoconducting band. This photoconducting surface has "bicharge" properties, namely it takes on both positive and negative charges. With this type of photoconductor it is thus possible to carry out inverted image development, whereby the monocomponent powder is deposited on the discharged zones of the photoconductor, while a positive voltage of 300 V with respect to the support of the photoconductor is applied to the magnetic brush—the charged image on the photoconductor being also positive. Thus the non-charged zones are developed, with the aid of the Hitachi HMT 824/4 toner.

The copy support is Ausseday-Rey paper, designation Unimat 80 g. The image transfer voltage is about 200 V. The results are:

In the absence of the dielectric liquid, the amount of toner transferred is 5%, and the image is blurred.

In the presence of the dielectric liquid (Isopar G), the amount of powder transferred is 95% and the copy image is clear.

EXAMPLE 12

This example comparatively summarizes a number of tests carried out with the arrangement of FIG. 4, with different toners having various resistivities. The dielectric used is Isopar G. For a given resistivity of the toner, the voltage between the photoconductor drum and roller 416 is varied on the one hand, and the illumination of the photoconductor is varied on the other, with the aim of obtaining the best possible image. Identical tests are carried out without the dielectric liquid. In the presence of the dielectric liquid the results are as shown in Table 1. The resistivity of the toner is measured according to the method cited supra. The illumination operation comprises the discharging of the photoconductor to a greater or lesser degree following the development of the powder image but before the transfer of the powder image. In the absence of the dielectric liquid, the results are as shown in Table 2.

TABLE 1

| | | | | | | |
|---|---|---|---|---|---|---|
| Resistivity of Toner | $1.3\times10^7$ | $1.7\times10^9$ | $3\times10^{10}$ | $10^{12}$ | $10^{13}$ | $>10^{15}$ |
| Transfer Voltage | 500 V | 500 V | 300 V | 400 V | 500 V | 500 V |
| Degree of Discharge of Photoconductor | 60% | 30% | 30% | 100% | 100% | 100% |
| Extent of Transfer of Powder | 65% | 75% | 90% | 80% | 90% | 95% |
| Clarity of Image | Slightly Blurred | Slightly Blurred | Clear | Clear | Clear | Clear |

These two tables show that regardless of the resistivity of the toner, the image obtained is always better in the presence of the dielectric liquid. This improvement is significant when the resistivity of the toner is less than $10^{15}$ ohm-cm$^2$/cm. Beyond this point, the improvement is less but still perceptible, particularly with regard to the amount of powder transferred.

TABLE 2

| $\Omega$ cm$^2$/cm Resistivity of Toner | $1.3 \times 10^7$ | $1.7 \times 10^9$ | $3 \times 10^{10}$ | $10^{12}$ | $10^{13}$ | $>10^{15}$ |
|---|---|---|---|---|---|---|
| Transfer Voltage | 500 V | 500 V | 300 V | 400 V | 500 V | 500 V |
| Degree of Discharge of Photoconductor | 60% | 30% | 30% | 100% | 100% | 100% |
| Extent of Transfer of Powder | None | None | 5% | 10% | 10% | 90% |
| Clarity of Image | — | — | Strong "explosion" effect | Strong "explosion" effect | "Exsion" | Clear |

EXAMPLE 13

This example shows the improvement obtained in image quality as a function of the resistivity of the dielectric liquid used, for a given toner, a given transfer voltage, and a given partial discharge of the photoconductor before transfer of the powder image. The test is carried out with the arrangement of FIG. 3. The toner used is HMT 824/4, the transfer voltage 300 V, the extent of discharge of the photoconductor after powder development 30%, and the receiving support Voiron Velin SH. The results are shown in Table 3.

| Resistivity of the Dielectric Liquid Used $\Omega \times$ cm$^2$/cm | zero | $10^5$ | $10^7$ | $7 \times 10^9$ | $9 \times 10^{14}$ |
|---|---|---|---|---|---|
| Extent of Transfer of Powder | 5% | 50% | 95% | 95% | 95% |
| Clarity of Image | Mediocre | Average | Fairly Good | Good | Very Good |

EXAMPLE 14

Production of a printed circuit

A sheet of electrographic paper of designation Regma R 220 is uniformly charged with the aid of a negative-type "corona" device. The transparent original drawing of a printed circuit is placed in contact with said paper sheet, and this combination is then exposed to light. The charged image thus formed is then developed with the aid of HMT 403 monocomponent developing powder.

A clear glass epoxy plate is copper coated and then treated with nitric acid to give good wettability of the coated face. This copper face is then covered over half its surface with a thin film of Isopar G, with the other half of the surface left untreated.

The copper coated plate is then placed on a grounded metallic plate, with the copper coated face facing upward. A contact is established between the metallic plate and the copper coated face, whereby the latter is grounded.

The electrographic paper bearing a powder image is placed over the copper coated face, with the powder image facing downward. A "corona" device is then moved uniformly over the entire extent of this combination (one forward pass and one return pass). This operation is carried out under illumination. Then the electrographic paper is lifted off and the transferred image is best-fixed at 150° C. This copper coated support is then etched with ferric chloride, and the remaining toner is then removed with the aid of trichloroethylene. The results are:

The half treated with Isopar G has an image representing about 90% transfer of the powder image, with very good image quality, and the etching has excellent definition, at least 3.6 lines per mm.

The untreated half has an image representing about 40% transfer of the powder image, and the image is "exploded."

What is claimed is:

1. A process of electrographic reproduction comprising the steps of:

(a) Forming an image of electrostatic charges on a temporary support, (b) Developing the image with a dry, conductive monocomponent developing powder in which a charge of either polarity is induced by the image of electrostatic charges to form a powder image, and (c) Transferring the powder image to an arbitrary support having deposited thereon a volatile dielectric liquid having a volume resistivity of greater than $10^3 \Omega$cm$^2$/cm, said volatile dielectric liquid not capable of readily dissolving the resins in the developing powder, the arbitrary support or the temporary support.

2. A process according to claim 1 wherein the powder image is fixed on the arbitrary support.

3. A process according to claim 1 or 2 wherein the powder image is transferred onto an arbitrary support which is a rigid metallic roller.

4. A process according to claim 3 wherein the powder image which has been first transferred onto the metallic roller is simultaneously transferred and fixed onto a copy support by cold pressure.

5. A process according to claim 4 wherein the powder image which has been first transferred onto the metallic roller is simultaneously transferred and fixed onto a copy support by cold pressure.

6. A process according to claim 4 wherein the volatile dielectric liquid is evaporated from the metallic roller prior to transferring onto the copy support.

7. A process according to claim 1 wherein the quantity of the volatile dielectric liquid applied to the arbitrary support is between 0.01 and 16 g/m$^2$.

8. A process according to claim 7 wherein the quantity of the volatile dielectric liquid applied to the arbitrary support is between 2 and 5 g/m$^2$.

9. A process according to claim 1 wherein the volatile dielectric liquid has a volume resistivity of from about $10^3$ to about $10^{15}\Omega cm^2/cm$.

10. A process according to claim 1 wherein the volatile dielectric liquid has a volatility index of from 0.01 to 0.4.

11. A process according to claim 1 wherein the volatile dielectric liquid has a boiling point between 60° C. and 230° C.

12. A process according to claim 1 wherein the volatile dielectric liquid is selected from the group consisting of straight chain aliphatic hydrocarbons, branched chain aliphatic hydrocarbons, saturated cyclic aliphatic hydrocarbons, polyisobutenes, polyfluoroethylenes and mixtures thereof.

13. A process according to claim 1 wherein the developing powder has a volumetric resistivity of from $10^7$ to $10^{15}\Omega cm^2/cm$, the volumetric resistivity being measured in a cell of cross section 0.07 $cm^2$ on a sample 2 mm deep under a pressure of 750 $g/cm^2$ and a continuous electric field of 1000 v/cm.

14. A process according to claim 1 including the additional step of subjecting the powder image to illumination prior to the transfer step.

15. A process according to claim 1 wherein the transfer step (c) is conducted using an electric field existing between the temporary support and the arbitrary support.

16. A process according to claim 1 wherein the transfer step (c) is conducted using a corona effect device.

17. A process according to claim 1 wherein the developing powder is magnetic.

18. A process according to claim 1 wherein the powder image is subjected to controlled illumination in order to obtain a partial discharge of the temporary support prior to the transfer step.

19. A process according to claim 13 wherein the developing powder has a volumetric resistivity of from $10^8$ to $10^{13}$ ohm-$cm^2/cm$.

* * * * *

UNITED STATES PATENT AND TRADEMARK OFFICE

CERTIFICATE OF CORRECTION

PATENT NO. : 4,373,016

DATED : February 8, 1983

INVENTOR(S) : KINGS, ET AL.

It is certified that error appears in the above—identified patent and that said Letters Patent is hereby corrected as shown below:

Claim 5, line 1, delete "4" and insert --3--;
line 3, delete "simultaneously" and "and fixed";
line 4, delete "by cold pressure" and insert --and fixed--.

Signed and Sealed this

*Fifteenth* Day of *November 1983*

[SEAL]

*Attest:*

GERALD J. MOSSINGHOFF

*Attesting Officer*

*Commissioner of Patents and Trademarks*